US008122538B2

(12) United States Patent
McBrearty

(10) Patent No.: US 8,122,538 B2
(45) Date of Patent: Feb. 28, 2012

(54) SOUVENIR COLLECTING MULTI PURPOSE WIND RESISTANT TOWEL WITH HIDDEN POCKETS

(75) Inventor: Alan McBrearty, Boca Raton, FL (US)

(73) Assignee: Alpha Sun & Sport - AS&S, LLC, Boca Raton, FL (US)

( * ) Notice: Subject to any disclaimer, the term of this patent is extended or adjusted under 35 U.S.C. 154(b) by 0 days.

(21) Appl. No.: 12/874,082

(22) Filed: Sep. 1, 2010

(65) Prior Publication Data

US 2011/0047697 A1 Mar. 3, 2011

Related U.S. Application Data

(60) Provisional application No. 61/239,127, filed on Sep. 2, 2009.

(51) Int. Cl.
*A47G 9/06* (2006.01)
*A47C 27/00* (2006.01)

(52) U.S. Cl. ..... 5/417; 5/419; 5/485; 5/656; 5/907; 297/219.1; 297/229

(58) Field of Classification Search ..... 5/417, 419, 5/485, 486, 656, 907; 297/219.1, 229
See application file for complete search history.

(56) References Cited

U.S. PATENT DOCUMENTS 4,195,378 A 4/1980 Parker
(Continued)

*Primary Examiner* — Michael Trettel
(74) *Attorney, Agent, or Firm* — Hyra IP, PLC; Clifford D. Hyra

(57) ABSTRACT

A wind-resistant, souvenir-collecting beach towel with hidden pockets has a towel portion, a compartment at one end of the towel portion, an opening accessible from the underside of the beach towel opposite the edge of the end of the towel portion where the compartment is, and a souvenir receiving portion forming a perimeter around the towel portion and having apertures where ball bungee cords and pegs are secured. The compartment has a top and a bottom layer and is attached to the underside of the towel portion and has hidden pockets. Some of the hidden pockets have openings recessed from an outside edge of the compartment such that the opening is not exposed to the environment and is not visible to passersby, and one of the hidden pockets is accessible only through the opening.

22 Claims, 3 Drawing Sheets

U.S. PATENT DOCUMENTS 4,273,380 A 6/1981 Silvestri
4,634,618 A 1/1987 Greer
4,656,670 A 4/1987 Schluter
4,877,288 A * 10/1989 Lee ..... 297/229
4,927,118 A 5/1990 Pierorazio
4,970,741 A 11/1990 Spina
4,980,935 A 1/1991 Kazanowski
4,999,866 A 3/1991 Lindsey
5,018,229 A 5/1991 Eberhart
5,072,467 A 12/1991 Hunt
5,082,707 A 1/1992 Fazio
5,206,964 A 5/1993 Wilson, Sr.
5,240,330 A 8/1993 Thompson
5,345,627 A 9/1994 Cammarata
5,346,308 A 9/1994 Buhot
5,361,435 A 11/1994 Reeves
5,406,659 A 4/1995 Camp
5,443,880 A 8/1995 Wike
5,474,275 A 12/1995 Robertson
5,629,071 A 5/1997 Feldman
5,644,807 A 7/1997 Battistella
5,688,052 A 11/1997 Compton
5,729,846 A 3/1998 Sullivan
5,843,556 A 12/1998 Levas
D414,067 S * 9/1999 Wickline et al. ..... D6/608
6,023,797 A 2/2000 Brumfield
6,061,849 A 5/2000 Seals
6,149,234 A 11/2000 Daniels
6,192,536 B1 2/2001 Connors
6,226,813 B1 * 5/2001 Wilburn et al. ..... 5/417
6,276,828 B1 8/2001 Otley
6,626,491 B1 * 9/2003 Blome et al. ..... 297/229
6,829,806 B2 12/2004 Egigian
6,839,921 B2 1/2005 Cloutier
7,000,984 B1 2/2006 Ward
7,024,733 B2 4/2006 Egigian
7,225,483 B1 6/2007 Remblad
2004/0124331 A1 7/2004 Kornacki
2004/0155077 A1 8/2004 Cullen
2006/0010598 A1 1/2006 Rusinak-Connors
2006/0024471 A1 2/2006 Cunningham
2006/0117480 A1 6/2006 Younce
2007/0017943 A1 1/2007 Foy
2007/0210628 A1 * 9/2007 Arnold ..... 297/229
2008/0052827 A1 3/2008 DeIntinis

* cited by examiner

SOUVENIR COLLECTING MULTI PURPOSE WIND RESISTANT TOWEL WITH HIDDEN POCKETS

This application claims the benefit of U.S. Provisional Application No. 61/239,127, filed Sep. 2, 2009, which is hereby incorporated by reference in its entirety.

FIELD OF THE INVENTION

The present invention relates generally to towels, blankets, mats and other similar products that are used at the beach or pool to lay down on.

SUMMARY

It is to be understood that both the following summary and the detailed description are exemplary and explanatory and are intended to provide further explanation of the invention as claimed. Neither the summary nor the description that follows is intended to define or limit the scope of the invention to the particular features mentioned in the summary or in the description. Rather, the scope of the invention is defined by the appended claims.

In certain embodiments, the disclosed embodiments may include one or more of the features described herein.

A new multipurpose wind resistant beach and chair/chaise towel has integrated concealed pockets and a place/border for add-on souvenir collectible patch and trinket attachments. An exemplary embodiment of the towel includes a substantially flat member comprising a peripheral border having a plurality of apertures disposed to accept securing means, the peripheral border also having a plurality of souvenir attachments; a large compartment configured at one end of the flat member, the large compartment having an opening and closing means and being accessible from an underside area of the flat member; and one or more inside hidden pockets and one or more zippered outer pockets, each configured on one or more sides of the large compartment. The inside hidden pocket(s) have opening and closing means and are accessible through the opening of the large compartment, and the concealed zippered outer pocket(s) have opening and closing means and are accessible through a zipper in the flat member. In some embodiments, the zipper is in a seam of the flat member.

A substantially flat member includes a peripheral border having a plurality of apertures disposed to accept securing means, the peripheral border also including a plurality of souvenir attachments. A compartment is configured at one end of the flat member, the compartment including an opening having a closing means and being accessible from an under side area of the flat member. One or more inside hidden pockets and one or more zippered outer pockets are configured in one or more sides of the compartment, the inside hidden pockets including an opening and closing means and accessible through the opening of the compartment, and the zippered outer pockets including an opening and closing means and accessible through a zipper in a seam of the flat member.

These and further and other objects and features of the invention are apparent in the disclosure, which includes the above and ongoing written specification, with the drawings.

BRIEF DESCRIPTION OF THE DRAWINGS

The accompanying drawings, which are incorporated herein and form a part of the specification, illustrate exemplary embodiments and, together with the description, further serve to enable a person skilled in the pertinent art to make and use these embodiments and others that will be apparent to those skilled in the art. The invention will be more particularly described in conjunction with the following drawings wherein.

LIST OF REFERENCE NUMERALS

Figure 1:
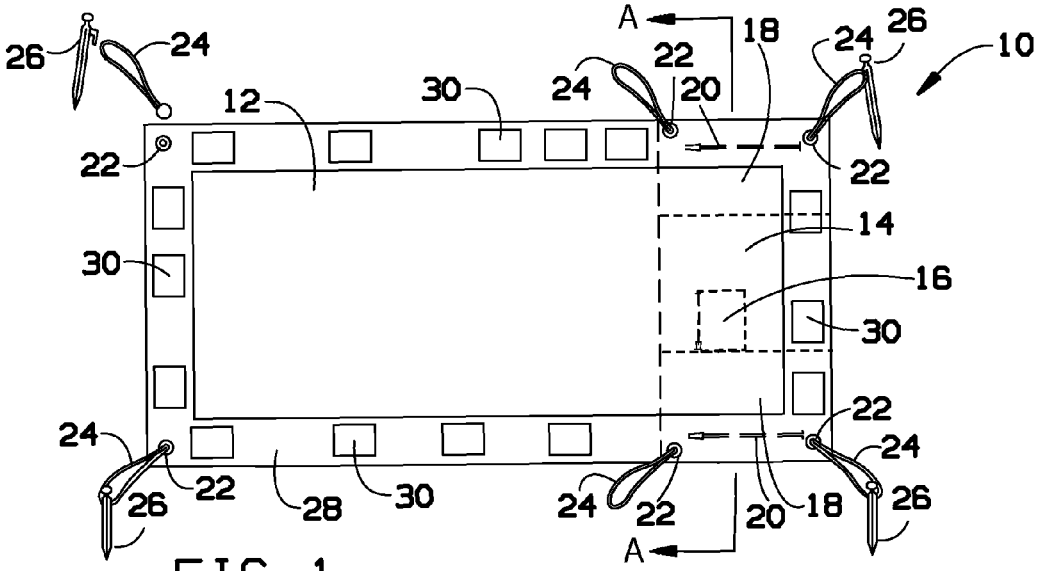
FIG. 1 shows a top view of a beach towel.

10: Towel
12: Central towel body portion
14: Large compartment
15: Gap between large compartment and the rest of the towel
16: Inside hidden pocket
17: Inside hidden pocket fabric layer
18: Side zippered protective hidden outer pocket
19: Side zippered protective hidden outer pocket sidewall stitching
20: Zipper
21: Edge seam between compartment and souvenir-collecting border
22: Grommet
23: Elastic band
24: Ball bungee cord
26: Ground peg
28: Souvenir attachment border
30: Souvenir patch attachments
32: Chair/chaise
34: Large compartment fabric piece
36: Stitching
38: Fold line
40: Large compartment sides
42: Recessed pocket opening
44: Towel edge stitching
46: Zipper attachment fabric

DETAILED DESCRIPTION

A souvenir collecting multipurpose wind resistant beach towel with hidden pockets will now be disclosed in terms of various exemplary embodiments. This specification discloses one or more embodiments that incorporate features of the invention. The embodiment(s) described, and references in the specification to "one embodiment", "an embodiment", "an example embodiment", etc., indicate that the embodiment(s) described may include a particular feature, structure, or characteristic. Such phrases are not necessarily referring to the same embodiment. When a particular feature, structure, or characteristic is described in connection with an embodiment, persons skilled in the art may effect such feature, structure, or characteristic in connection with other embodiments whether or not explicitly described.

In the several figures, like reference numerals may be used for like elements having like functions even in different drawings. The embodiments described, and their detailed construction and elements, are merely provided to assist in a comprehensive understanding of the invention. Thus, it is apparent that the present invention can be carried out in a variety of ways, and does not require any of the specific features described herein. Also, well-known functions or constructions are not described in detail since they would obscure the invention with unnecessary detail.

The description is not to be taken in a limiting sense, but is made merely for the purpose of illustrating the general principles of the invention, since the scope of the invention is best defined by the appended claims.

When people go to the beach or pool, their towel, blanket or mat is difficult to maintain in place as it is always being blown around by wind gusts or simply when one is turning over. Their small personal items are often left in the open or hidden under the towel/blanket or mat where they are exposed to prying eyes, sand, water and other elements. Finally there are difficulties and dilemmas with respect to choosing, buying, and managing/storing/saving one's or friends' and family's travel souvenirs.

In embodiments of the present invention, towels, blankets, mats or other similar products are secured from always being disrupted when used in windy weather conditions and a secure place to put small personal items is provided, all while allowing a user to conveniently collect and attach souvenirs of travels and adventures in one location, making it one giant ever-evolving souvenir in itself.

FIGS. 1-5 show a personal travel and adventure towel 10 that can be secured to a lawn chair 32 or in the sand through the use of grommets 22, ball bungee cords 24 and pegs 26 and has protective hidden pockets 16 and 18 sewn into the towel 10 and a souvenir attachment border 28 or location where one can add/attach travel and adventure souvenir patch attachments 30 from places they have visited, or from places their friends and family have visited.

Figure 2:
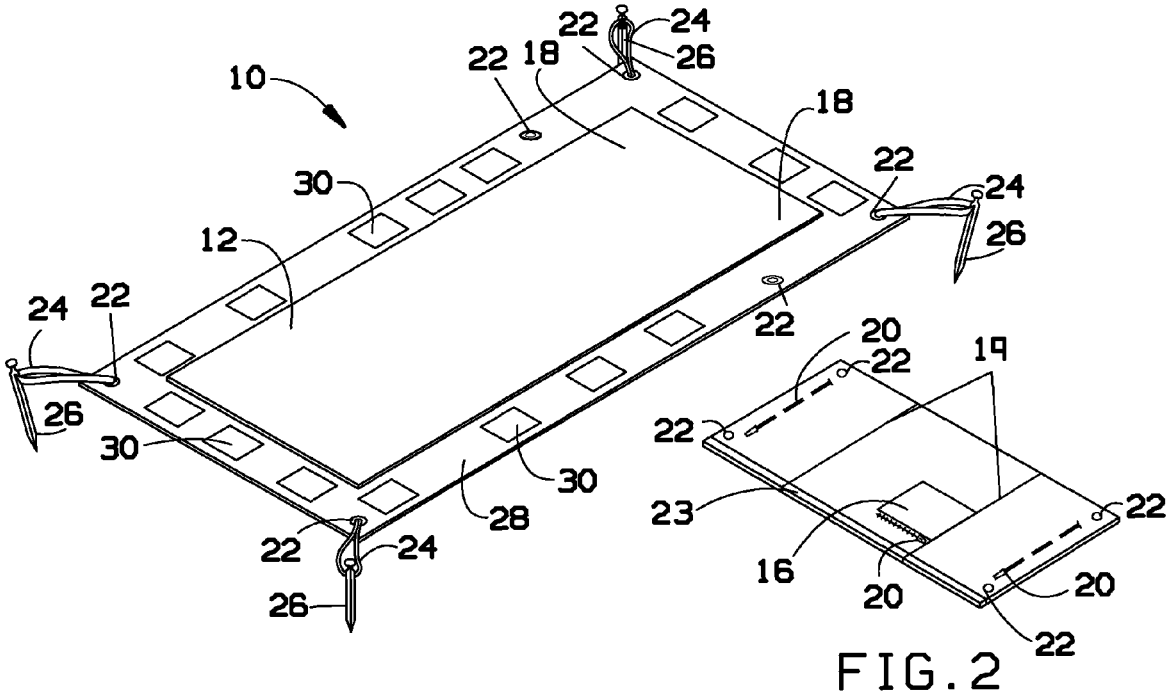
FIG. 2 shows a perspective view of a beach towel with large compartment detached.

FIG. 1 is a top view of a towel 10. FIG. 2 is a perspective view of a towel 10, in which the shorter height of the souvenir attachment border 28 compared to the central body portion 12 of the towel can be seen, as well as the multiple layers of the compartment 14. In all figures, hidden features not visible to an outside observer from the viewpoint of the figure are shown in broken lines.

The towel 10 has one large compartment 14 which in some embodiments is 20" or 30" to 48" wide but in one embodiment is 40" wide, across the top and extending down in some embodiments 12" to 20" but in one embodiment 17". Between this compartment 14 and the rest of the towel is gap 15, which is open along the bottom of the compartment 14 and accessible from the underside of the towel 10 for going over the backrest of a lawn chair or car seat, or the insertion of an inflatable pillow. In the illustrated embodiment, the compartment is attached to the souvenir border 28 along its other three sides, and the gap 15 is not accessible from those sides. Elastic band 23 is attached along the bottom side of the compartment to keep the opening taught around an inserted object. In one embodiment elastics are used to keep this opening taught, in some embodiments some other method is used to keep it closed, keeping an inflatable pillow or loose clothing or similar secure, for example hook and loop fasteners, clips, snaps, or the like.

The towel has one or more inside hidden pockets that in various embodiments are on the right, left, or both sides, or on the center, of the large compartment and are truly hidden, ranging in certain embodiments from 3" to 12" wide and 7" to 20" long but in one embodiment being 7"×7". In the embodiment illustrated in the figures, a single inside hidden pocket 16 is located near the center of large compartment 14 and secured with a zipper 20.

These inside hidden pocket(s) are only accessible from the underside of the towel and through the horizontal opening of the large compartment, thus removing personal items from the elements or the public eye and avoiding quick access to those simply walking by. These inside hidden pocket(s) in certain embodiments have vertical or horizontal openings of approximately 5" to 12" which may be left open, or may be secured with a zipper, hook and loop fasteners, buttons, clamps, snaps, hooks, magnets, or any other such type of device that may be used as a form of closure. It is also understood that zippers could easily be placed in plain sight on either the top or bottom of towel instead of inside, but this would defeat the purpose of the secret aspect of the hidden pocket and would also expose the zipper to sand and other elements resulting in shortened life expectancy as well as reducing smooth operation of the zipper.

In some embodiments, the towel also has one or more concealed side zippered outer pockets as additional pockets, which in certain embodiments are to the left, right, or both sides and in some embodiments are to the opposite side of the inside hidden pocket. In the embodiment illustrated by the figures, the single inside hidden pocket 16 is accompanied by side zippered outer pockets 18 on either side of the large compartment 14. The concealed side zippered outer pockets in certain embodiments range 3" to 12" wide and 7" to 20" long, but in one embodiment are 9"×17". These zippered outer pockets in some embodiments have a convenient 5"-12" plastic or polyester zipper sewn inconspicuously into the seam 21 or 3" inside the seam or into the edge of the towel or vertically, along the line/plane where the souvenir border and central body of the towel meet. This zipper is easily accessible from the side, thus removing personal items from the elements or the public eye and avoiding quick access to those simply walking by.

Figure 3:
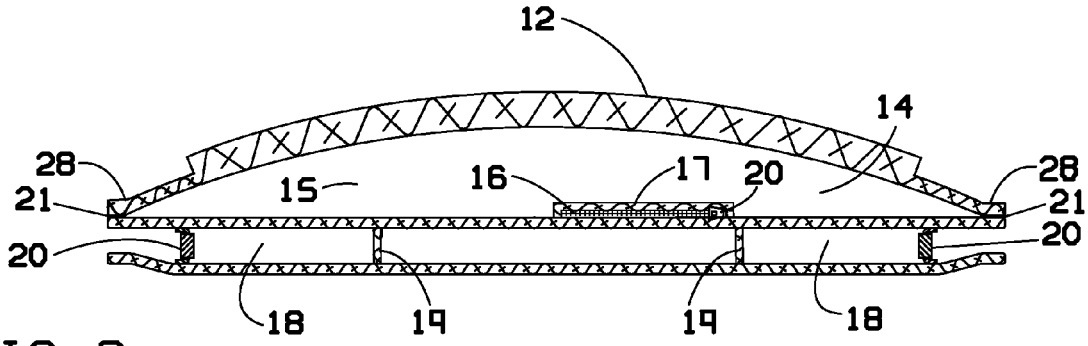
FIG. 3 shows a section view of the beach towel of FIG. 1 taken along line A-A.

FIG. 3 is a cross section taken along line A-A in FIG. 1, and shows the structure of the pockets. The embodiment is shown with the central towel body portion 12 pulled away from the compartment 14 to enlarge gap 15 for illustrative purposes, but when laying flat with nothing inserted between them, the central body portion 12 and compartment 14 are typically substantially adjacent. In this embodiment, side zippered outer pockets 18 are formed between the layers forming the large compartment 14 and a stitching 19 of the two layers. Inside hidden pocket 16 with zipper 20 is formed between the upper layer of the enclosure 14 and a separate layer of fabric 17. Zippers 20 of side zippered outer pockets 18 are recessed from the edges 21 of the seam joining the enclosure and souvenir-collecting border for concealment. In other embodiments, the pockets may be formed in various other ways, utilizing the existing layers of the enclosure as well as additional fabric.

Although in the illustrated embodiment access to the side zippered outer pockets 18 is a zipper 20, other potential forms of closure such as hook and loop fasteners, buttons, clamps, snaps, hooks, magnets, or the like are also used in some embodiments. It is also understood that the zippers 20 could easily be placed in plain sight on either the top or bottom of towel 10 instead of being installed in the seam, but this would defeat the purpose of the secret aspect and inconspicuousness of the side zippered pocket 18 and would also expose zipper 20 to sand and other elements resulting in shortened life expectancy as well as reducing smooth operation of zipper 20.

Figure 6:
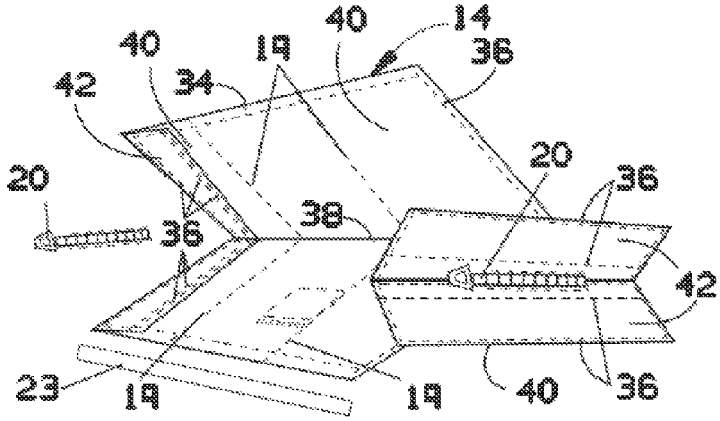
FIG. 6 is an exploded diagram of the back side of a beach towel showing the assembly of the large compartment.
Figure 6:
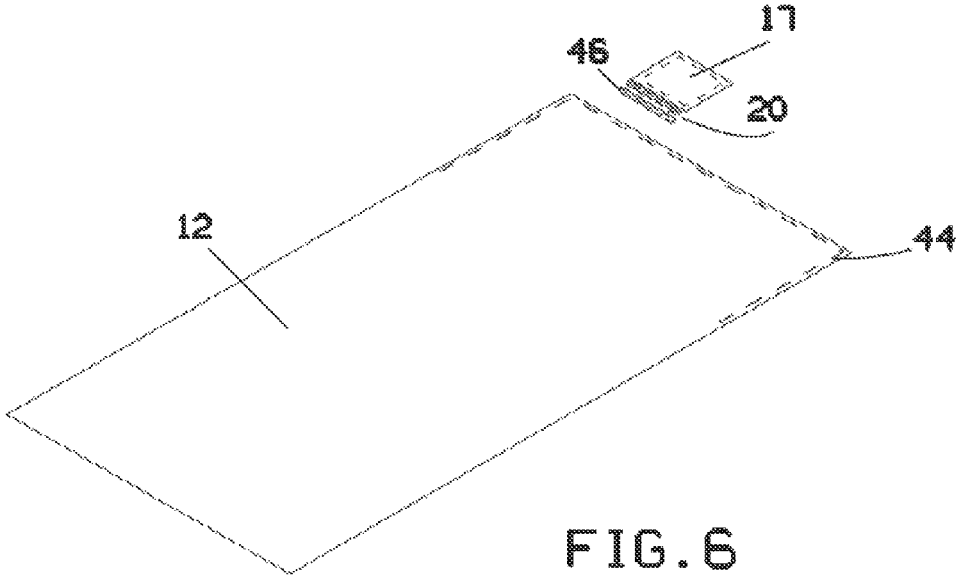

FIG. 6 is an exploded view diagram of the back side of a beach towel showing the assembly of the large compartment 14 in one exemplary embodiment. In this figure, all dashed lines indicate stitching 36. A single piece of fabric 34 is folded in half along fold line 38. One or more of the compartment sides 40 are folded inwards and the top and bottom sides sewn together around zipper 20 to create a recessed pocket opening 42 (shown detached from the compartment 14). The two ends of the fabric 34 are sewn together with an elastic band 23 and together with sidewall stitching 19 create the hidden side pockets 18 between the opening 42 and sidewall stitching 19 and elastic band 23. Inside hidden pocket fabric layer 17 is sewn to the top of the compartment 14 and zipper attachment layer 46 to form the inside hidden pocket 16 and zipper 20 is sewn to the zipper attachment fabric piece 46 to provide the hidden pocket's opening. The top half of compartment 14 is sewn to the rest of the towel with stitching 44 along three edges, allowing a resulting gap 15 between compartment 14 and the rest of the towel to be accessed from the bottom of the compartment 14 on the back side of the towel 10.

The lumps created from personal items in the pockets can be made harder to see by the insertion of an inflatable pillow or one's clothing in the large compartment.

In the figures, the towel 10 has grommets 22 placed in the souvenir attachment borders 28, in each corner and two more at the lower part of the side pockets (for use on lawn chairs 32). In other embodiments, grommets are located at other spots on the towel. The corner grommets are in some embodiments 1-2 inches from each corner.

In the illustrated embodiments the towel 10 has four to six tarp or canopy style ball bungee cords 24, which in some embodiments are 8" to 16" but in one embodiment 9" to 12", that can be inserted into the grommets 22 as shown, allowing the towel 10 to be secured to lawn chairs 32 or attached to ground pegs 26. Because of their elastic nature, the ball bungee cords 24 allow for some give and take when moving around on the towel 10 or if there should be a big gust of wind and as such avoiding tearing to the towel 10. In some embodiments hooks are used instead of the ball on one or more of the bungee cords.

The towel 10 in the illustrated embodiment also comes with four ground pegs 26 that in some embodiments are 4"-12", in some embodiments 6"-9", for securing towel 10 in the ground when at the beach, camping, or the like and that can be attached to the ball bungee cords 24 as shown in FIGS. 1-2. Because of their elastic nature, the ball bungee cords allow for some give and take when moving around on the towel or if there should be a big gust of wind and as such avoiding tearing to the towel.

In some embodiments, including the illustrated embodiments, the towel is bordered on all four sides by a seam or souvenir attachment border, which in some embodiments is approximately 4" to 6" wide and in one embodiment 5" wide, onto which "iron-on" travel associated souvenir collectible patch and trinket attachments may be attached or affixed to commemorate each milestone traveled or adventure completed. These souvenir attachments in some embodiments are made to blend together seamlessly with the towel and as such may be attached anywhere on the towel if space should run out from their designated places on the souvenir attachment border. In some embodiments, the towel comes with one or more souvenir patch attachments pre-attached. For example, where the towel is sold at a location that has a corresponding souvenir patch attachment, that souvenir patch attachment may be pre-applied to the towels sold there.

These iron-on travel souvenir collectible patch and trinket attachments are part and parcel to the design in some embodiments and are made available at various travel locations worldwide according to the towel theme that the individual has chosen. For example, one theme is most beautiful or sexiest beaches and souvenir patch attachments are made available at souvenir shops in these locations. Souvenir patch attachments are also available at other popular travel destinations for other themes such as most popular cities, tourist attractions/milestones, and greatest golf courses and space is available on the towel for these as well.

In essence, various themed towels and corresponding travel collectible iron-on souvenir patch attachments are made available for most things that the Alpha or active personality likes to do or visit, such as: cities and their major landmarks, attractions and excursions, theme parks, adventure tours and rides, cruises, sightseeing destinations, golf, racing, water sports (including surfing and kite surfing, scuba diving, and the like), extreme sports (sky diving, bungee jumping, and the like). Each towel has a certain amount of extra space on the souvenir attachment border to allow adding souvenir patch attachments from other places that are not part of their chosen theme, allowing for cross marketing of souvenir patch attachment collectibles. These attachments are great for remembering places visited and dreaming of places yet to discover as well as being used to make the towel a large, constantly evolving souvenir in itself. The whole towel and the souvenir patch attachment combination is a great conversation piece for anyone traveling or who loves to travel, both young and old, all while being a great memory keepsake of one's personal travels and adventures. Because of the different materials used in some embodiments for the souvenir collectible attachments, many of them are also well suited for affixing to T-shirts, travel pants or shorts, jeans, wind breakers, or the like, so as to create one large individual souvenir or keepsake of a more special trip or adventure.

Although normally rectangular in shape, the towel in some embodiments is square, oval, round, pentagonal, hexagonal, or other shapes. Although made of velour cotton terry, in some embodiments it is also made of other fabrics or cloth-like materials and varies in such things as quality of cotton, velour, French or looped terry, thickness, absorbency (chamois) or the like. Varying stitching and quilting methods are used in various embodiments. The towel terry material in some embodiments is manufactured in a larger terry cloth fabric, cut into towel shaped sizes, and souvenir attachment borders are added or sewn on subsequently. Additionally, in some embodiments souvenir attachment borders are put along only one, two, or three sides instead of all four sides of the towel.

The large compartment and the protective hidden pockets are in some embodiments located on the underside and at the top of the towel, however, in other embodiments they are placed over the towel, with the large compartment along any side and the pockets at any corner. Additionally, in some embodiments they start from the edge, instead of allowing the space for a souvenir attachment border. The towel is in one embodiment manufactured by using the process of sewing, but in some embodiments is constructed using other known binding methods such as rivets, glues or other adhesives, or the like.

The pockets in some embodiments are designed and sewn using rectangles with 90° angles, but in some embodiments are made to incorporate curves, angles less than or greater than 90°, or are of different size proportions. In some embodiments plastic or polyester zippers are used as the closing method for the pockets, but in some embodiments any other kind of zipper (steel or another material) or closing method such as buttons, hook and loop fasteners, clips, or the like are used. The large compartment and protective hidden pockets are in some embodiments initially made separately and lined with a waterproof material prior to being attached or sewn to the towel. In some embodiments, the large compartment is formed by folding over the top of the towel and sewing or otherwise affixing it to the bottom of the towel. In some embodiments the pockets are secret and inconspicuous, however, zippers in some embodiments are placed in plain sight on either the top or bottom of towel instead of being installed in the seam or the large compartment, but this does defeat the purpose of the secret aspect and inconspicuousness of the protective hidden pockets and also exposes the zippers to sand and other elements, resulting in shortened life expectancy as well as reducing smooth operation of zippers.

In some embodiments grommets are used as the method of attaching the ball bungee cords, but in some embodiments other things such as button holes, clamps, clips, or the like are used. Additionally, these grommets in some embodiments are placed at other areas on the towel and at different spacing intervals.

The ball bungee cords in some embodiments are interchanged with single length bungee cords and hooks, have varying sizes, and/or are simply something else such as plain rope, or the like.

The souvenir attachment border in certain embodiments is of various sizes and width. In some embodiments it has a different density of material from the rest of the towel and/or is of contrasting colors, designs, or the like.

The souvenir patch attachments in some embodiments are made by embroidery or other material and sewn to the towel instead of the iron-on fusing process. Other adhesives not requiring heat are used in some embodiments for this purpose.

In some embodiments, the towel is available in different sizes. The sizes given herein are merely exemplary and can be adapted to suit the purpose of the towel. For example, the singles model in certain embodiments is from 30" to 48" wide and from 48" to 84" long and in one embodiment 40"×72". The couples' model which in one embodiment is as large as 84"×84" is in one embodiment 60"×72". An infant and dog model in certain embodiments is available in square format of 36"×36" or 48"×48". The towel is generally designed to allow a human being to lie down on, but can be used to cover or wrap oneself up as well. Although normally rectangular in shape, in some embodiments it also comes in many other different shapes such as square, oval, round, pentagonal, hexagonal, or other shapes. Although made of velour cotton terry in one embodiment, in some embodiments the towel is also made of other fabrics and varies in such things as quality of cotton, velour, French or looped terry, thickness, absorbency, and the like.

The following describes a few other ways in which the towel may be used. Although it is useful for laying on, the towel is also a welcome addition for scuba divers, as they are always looking for a place to put their keys and wallets while in the water. Hidden pockets are the perfect thing for this, all while the towel is readily available to wrap oneself when exiting the water and protecting from the wind as the diver travels to the next dive site. These are things that many other people will find beneficial in their favorite activity.

The towel may be used as a travel blanket for use in cars, planes, or the like. One may use the large compartment to keep their feet warm and use the body of the towel to cover oneself.

It may also be used as a blanket for sporting events or concerts where the large compartment may be used as a hood if required and the hidden pockets may come in very handy. For example, in some embodiments sports or band themed towels have souvenir patch collectibles attachments of their favorite teams, players, or musicians.

Picnic blankets utilize the same concept, and teenagers may sit on them during lunch at school. In some such embodiments, the pillow in the large compartments is used to sit on.

A much smaller version may be used as a golf towel with the middle compartment used for placing over a golf club and the side pockets for balls and tees, or the like.

The souvenir patch collectible attachments in some embodiments are made of different materials so that they are better suited for affixing to T-Shirts, travel pants or shorts, jeans, wind breakers, or the like.

The towels may also simply be hung from nice wall mounts and the ball bungee cords removed to become a wall decoration in for example a teenager's room or someone's den, for remembering places visited and dreaming of places yet to discover as well as being used as a large constantly evolving souvenir in itself through the adding of various souvenir attachments. It is a great conversation piece for anyone traveling or who loves to travel both young and old, all while being a great memory keepsake of one's personal travels and adventures.

Examples of systems that benefit from the present invention are those of cruise lines, hotel chains, and the like, who have elaborate systems to achieve the greatest customer satisfaction levels possible. The towel in some embodiments is personalized and used as part of a cruise line's or hotel chain's service, since these solve many of the issues encountered on a ship's decks or by hotel pools with wind and personal items. In some embodiments they also have souvenir attachments for all their ports of call, adding to the sales of their on board stores or as giveaways in their sponsored island shops. Hotels in some embodiments have souvenir attachments for all their locations and local attractions.

In certain embodiments, the present invention provides a comfortable and soft-feeling place to lie on when at the beach or pool and is nice and warm when needing to dry off or cover oneself. It has an easy securing method for sand or lawn chairs that stops it from flying away or moving around when in use. There are integrated protective hidden pockets to hide small personal items and best of all it provides a place and method for collecting and managing souvenirs during one's many travels and adventures.

The present invention in some embodiments includes printing travel, adventure and other themes to the towel shaped terry material, which is manufactured with a flatter material for the souvenir attachment border, which is designed to host souvenir collectible attachments on all sides. In some embodiments, the towel and souvenir border are manufactured together in one piece using a manufacturing process involving two distinct kinds of weaving and looping of the towel material performed in a single process. Starting with a piece of e.g. terry material, the central body portion of the towel is woven into longer loops, while the souvenir attachment border is woven into tighter and shorter loops. The tighter and shorter loops of the souvenir attachment border allow the souvenir patches to stick closely and evenly to the towel. Longer loops would make it more likely for things to be caught in between a patch and base material and allow patches to be more easily pulled off the material. The longer-looped central body portion of the towel is softer and the souvenir attachment border is somewhat rougher.

Materials are then cut according to pattern and sewed into large compartment and protective hidden pockets with their closing mechanisms at one end. Grommets are then installed by first punching a hole in desired locations and pressing together and then slipping ball bungee cords through the grommet and adding a clip to ball bungee cord to prevent slippage out of the grommet. Additionally, multiple iron-on souvenir patch attachments are manufactured according to the various travel/adventure themes and according to destination using various towel and/or other material along with heavy duty fusible web.

A person may use the invention in the following ways:

Beach/camping on ground: A person first lays the towel flat in the desired location and direction. The person then anchors the lower part of the towel using the ball bungee cords and ground pegs. In some embodiments, the top part of the towel is folded over so as to first insert important personal items that will not be required in the immediate future such as money, wallet, keys, or the like in the inside hidden pocket and then folding and inserting any clothing that will not be required and/or optional inflatable pillow into the large compartment. Once this has been done the towel can be extended fully and the top part anchored the same as the lower part. The side zippered pockets may be used for items requiring quick access such as phone or music device, or the like and letting the earphones or headset exit from the top of the zipper.

Figure 4:
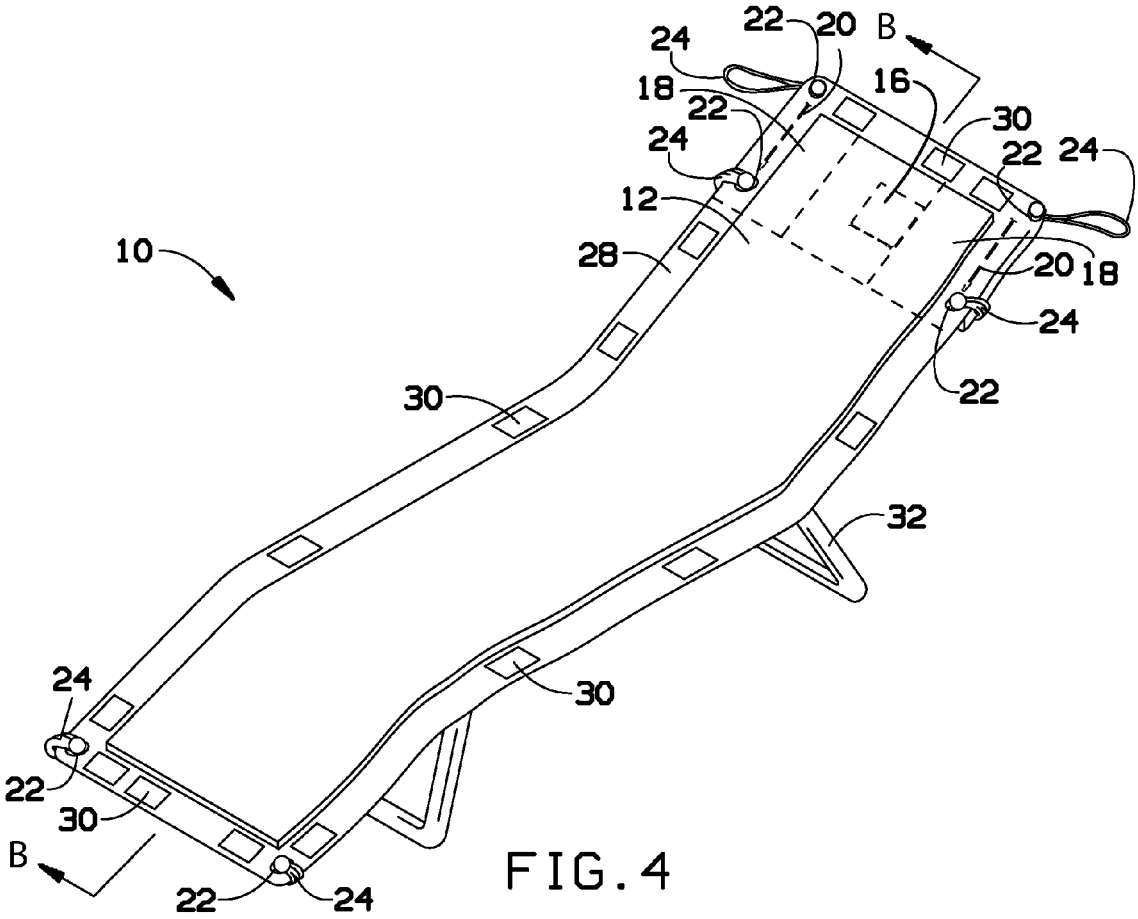
FIG. 4 shows a perspective view of a beach towel on a chair.
Figure 5:
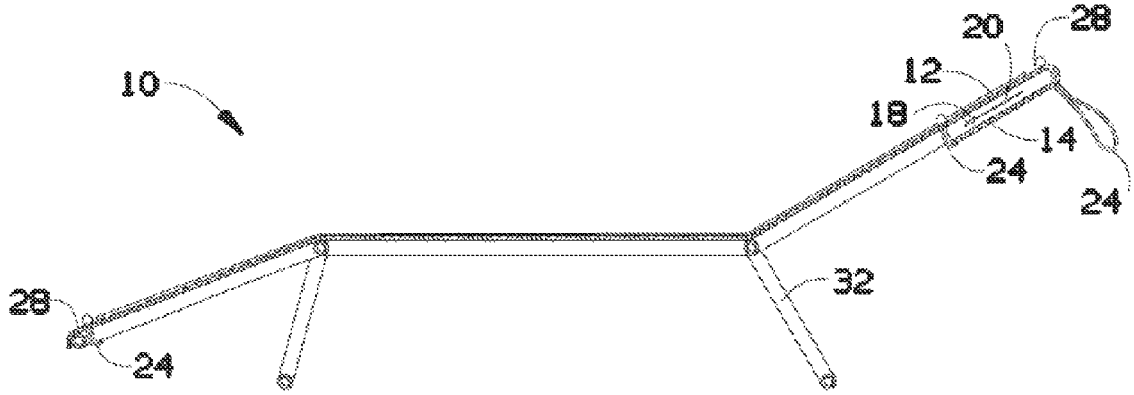
FIG. 5 shows a section view of the beach towel of FIG. 4 taken along line B-B.

Using a long chair: FIGS. 4 and 5 illustrate use of the towel on a long chair. A person starts by placing personal items that will not be required in the immediate future, such as money, wallets, keys, or the like in the inside hidden pocket 16 and then sliding the large compartment 14 over the back rest of the lawn chair 32. Once this has been done, the bungee cords 24 are slipped around one of the chair's 32 bars or straps and brought back to slip over the ball of the bungee cord 24. The same is then done with the lower ball bungee cords 24 using their existing grommets 22. The side zippered outer pockets 18 may be used for items requiring quick access such as phone or music device, or the like and letting the earphones or headset exit from the top of the zipper 20. The optional Inflatable pillow can always be used but is not necessary when using lawn chairs 32.

Current beach/pool towels/blankets do not have easy to use grommets or a ball bungee cords and peg combination for securing a towel in place in any situation or location. They do not have a large compartment for inserting an inflatable pillow as well as inside hidden pockets that are inconspicuously sewn into the towel for hiding small personal items, and, most importantly, they are not made to accommodate a way or place in which travel/adventure associated souvenir collectible patch and trinket attachments may be attached to commemorate each milestone traveled. Some of these attachments are made of the same soft towel material, allowing them to blend together seamlessly and be part and parcel to the design of the towel.

It is an object of the present invention to provide an ever evolving travel souvenir collecting beach/pool towel or blanket that is optimized by its wind resistant capabilities, its protective hidden pockets for storing personal items and a large compartment for inserting an optional inflatable pillow or other items.

The invention is not limited to the particular embodiments illustrated in the drawings and described above in detail. Those skilled in the art will recognize that other arrangements could be devised, for example, various shapes and sizes of towels made with various materials and having various securing devices and pockets. The invention encompasses every possible combination of the various features of each embodiment disclosed. While the invention has been described with reference to specific illustrative embodiments, modifications and variations of the invention may be constructed without departing from the spirit and scope of the invention as set forth in the following claims.

What is claimed is:

1. A towel, comprising:

a towel portion comprising a front, back, and sides;

a compartment, comprising one or more layers, at an end of the towel portion; and an opening between layers of the compartment or between the compartment and the towel portion that is accessible from the underside of the towel portion;

wherein the compartment comprises one or more pockets between layers of the compartment or between a layer of the compartment and the towel portion;

wherein one or more of the one or more pockets are hidden pockets;

wherein one or more of the hidden pockets is accessible between a side of the towel portion and an adjacent compartment layer, wherein the one or more of the hidden pockets has a closure device recessed from an outside edge of the compartment whereby the one or more of the hidden pockets is not exposed to the environment and not visible to passersby.

2. The towel of claim 1, wherein the compartment comprises a top and a bottom layer and is attached to the underside of the towel portion.

3. The towel of claim 1, wherein the opening is along a side of the compartment opposite the edge of the end of the towel portion where the compartment is.

4. The towel of claim 1, wherein one or more of the hidden pockets is accessible only through the opening.

5. The towel of claim 1, further comprising a souvenir receiving portion adjacent to the towel portion, wherein the compartment comprises a top and a bottom layer and is attached to the underside of the towel portion, wherein the opening is along a side of the compartment opposite the edge of the end of the towel portion where the compartment is, wherein one or more of the hidden pockets is accessible only through the opening, wherein the souvenir receiving portion forms a perimeter around the towel portion, wherein the souvenir receiving portion comprises one or more apertures for receiving one or more securing structures.

6. The towel of claim 1, further comprising one or more apertures configured to receive a securing structure and one or more securing structures;

wherein the one or more apertures comprises six or more apertures, wherein four of the apertures are located in corners of the towel portion and two are located in the towel portion adjacent the opening, whereby the compartment can be secured to a chair at its opening by the securing structures.

7. The towel of claim 6, wherein the securing structures comprise ball bungee cords and pegs, wherein balls of the ball bungee cords are larger than the apertures to serve as retaining means, and wherein the pegs are removably attached to bungee cords of the ball bungee cords.

8. The towel of claim 1, further comprising a souvenir receiving portion adjacent to the towel portion.

9. The towel of claim 8, wherein the souvenir receiving portion further comprises a plurality of souvenir attachments.

10. The towel of claim 8, wherein the souvenir receiving portion forms a border along one or more edges of the towel portion.

11. The towel of claim 8, wherein the souvenir receiving portion is thinner than the towel portion for easier application of souvenir attachments.

12. The towel of claim 8, wherein the souvenir receiving portion comprises one or more apertures for receiving one or more securing structures and one or more securing structures.

13. The towel of claim 8, wherein the towel portion and souvenir receiving portion are made of a single piece of fabric comprising fabric loops and a portion of the fabric forming the souvenir receiving portion comprises shorter and tighter loops than a portion of the fabric forming the towel portion.

14. The towel of claim 8, wherein the souvenir receiving portion is configured to secure iron-on or sewn-on souvenir attachments.

15. The towel of claim 1, wherein one or more of the hidden pockets is accessible between adjacent compartment layers.

16. A towel, comprising:

a towel portion;

a compartment comprising two sandwiched, coextensive layers;

wherein the compartment is attached to and covers one end of the towel portion;

wherein a pocket smaller than the compartment is formed between the compartment and the towel portion;

wherein hidden pockets are formed between layers of the compartment or between one or more layers of the compartment and one or more additional layers.

17. The towel of claim 16, wherein the two layers are equal in size and share an outer perimeter.

18. A towel, comprising:

a towel portion comprising a front, back, and sides;

a compartment, comprising one or more layers, at an end of the towel portion; and an opening between layers of the compartment or between the compartment and the towel portion that is accessible from the underside of the towel portion;

wherein the compartment comprises one or more pockets between layers of the compartment or between a layer of the compartment and the towel portion;

wherein one or more of the one or more pockets are hidden pockets;

wherein one or more of the hidden pockets is accessible between a side of the towel portion and an adjacent compartment layer;

one or more apertures configured to receive a securing structure and one or more securing structures, wherein the securing structures comprise ball bungee cords and pegs, wherein balls of the ball bungee cords are larger than the apertures to serve as retaining means, and wherein the pegs are removably attached to bungee cords of the ball bungee cords.

19. A towel, comprising:

a towel portion; and a souvenir receiving portion adjacent to the towel portion;

wherein the towel portion and souvenir receiving portion are made of a single piece of fabric comprising fabric loops and a portion of the fabric forming the souvenir receiving portion comprises shorter and tighter loops than a portion of the fabric forming the towel portion.

20. The towel of claim 19, wherein the souvenir receiving portion comprises one or more souvenir attachments.

21. A towel method, comprising:

providing a towel portion having a front, back and sides;

attaching a compartment to the underside of one end of the towel portion comprising a top and bottom layer and forming an opening along a side of the compartment opposite the edge of the end of the towel portion where the compartment is attached that is accessible from the underside of the towel portion;

providing one or more hidden pockets between layers of the compartment or between a layer of the compartment and the towel portion, wherein one or more of the hidden pockets is accessible from between a side of the towel portion and an adjacent compartment layer and has a closure device recessed from an outside edge of the compartment whereby the one or more of the hidden pockets is not exposed to the environment and not visible to passersby, and one or more of the hidden pockets is accessible only through the compartment opening; and providing a souvenir receiving portion adjacent to and forming a perimeter around the towel portion and comprising one or more apertures for receiving one or more securing structures.

22. A towel, comprising:

a towel portion;

a compartment at an end of the towel portion; and an opening between layers of the compartment or between the compartment and the towel portion that is accessible from the underside of the towel portion;

wherein the compartment comprises one or more pockets between layers of the compartment or between a layer of the compartment and the towel portion;

wherein one or more of the one or more pockets are hidden pockets;

further comprising a souvenir receiving portion adjacent to the towel portion;

wherein the souvenir receiving portion comprises delineated souvenir placement areas indicated by a graphic design differing from the remainder of the souvenir receiving portion, whereby a user can properly place souvenir attachments with ease.

* * * * *